United States Patent [19]

Cotic et al.

[11] Patent Number: 4,727,989

[45] Date of Patent: Mar. 1, 1988

[54] AUTOMATIC TIE PLATE ORIENTATION SENSING SYSTEM

[75] Inventors: Dennis J. Cotic, Waukesha; Andrew M. Dieringer, Waterford, both of Wis.

[73] Assignee: Oak Industries, Inc., Rancho Bernardo, Calif.

[21] Appl. No.: 6,865

[22] Filed: Jan. 27, 1987

[51] Int. Cl.[4] ..... B07C 5/00

[52] U.S. Cl. ..... 209/546; 209/598; 209/600; 209/911; 33/552; 198/395; 198/399

[58] Field of Search ..... 198/502.2, 394, 395, 198/399, 400, 382, 398, 401; 209/600, 601, 604, 598, 529, 530, 546, 549, 552, 911; 235/448; 340/676; 194/328; 33/552, 554, 557, 560

[56] References Cited

U.S. PATENT DOCUMENTS

| | | | |
|---|---|---|---|
| 3,013,445 | 12/1961 | Enssle | 198/502.2 X |
| 3,433,966 | 3/1969 | Letch et al. | 198/395 X |
| 3,882,785 | 5/1975 | Rowe | 104/16 |
| 3,943,858 | 3/1976 | Dieringer et al. | 104/16 |
| 4,178,671 | 12/1979 | Luttig | 29/429 |
| 4,241,663 | 12/1980 | Lund et al. | 104/16 |
| 4,280,613 | 7/1981 | Stewart | 198/406 |
| 4,393,784 | 7/1983 | Theurer | 104/2 |

FOREIGN PATENT DOCUMENTS

| | | | |
|---|---|---|---|
| 267236 | 5/1965 | Australia | 198/502.2 |
| 433627 | 9/1926 | Fed. Rep. of Germany . | |
| 308954 | 3/1969 | Sweden | 198/395 |
| 386049 | 10/1973 | U.S.S.R. . | |
| 509398 | 4/1976 | U.S.S.R. | 198/398 |
| 644897 | 1/1979 | U.S.S.R. . | |
| 652257 | 3/1979 | U.S.S.R. . | |
| 765445 | 9/1980 | U.S.S.R. . | |

*Primary Examiner*—Robert J. Spar
*Assistant Examiner*—Cheryl L. Gastineau
*Attorney, Agent, or Firm*—Silverman, Cass, Singer & Winburn, Ltd.

[57] ABSTRACT

An electro-mechanical orientation system for conveyed articles having a distinguishable top and bottom such as a rail tie plate or the like is disclosed comprising a sensor frame having a transverse pivot axis, a plurality of elongate sensor fingers pivotable about that axis and subject to a biasing force, a plurality of notched beam interceptors, one mounted to each sensor finger, a corresponding plurality of opto switches and a logic circuit, whereby the frame is oriented in relation to a conveyor surface so that the sensor fingers intercept and are triggered by the conveyed article. The pattern of triggered sensor fingers is transmitted through the beam interceptors and opto switches to the logic means, from where it may be used to trigger a conveyed article reorientation device.

20 Claims, 6 Drawing Figures

AUTOMATIC TIE PLATE ORIENTATION SENSING SYSTEM

BACKGROUND OF THE INVENTION

The present invention relates to orientation sensing systems for conveyed articles having a "right" or "wrong" conveyed orientation, and more specifically relates to orientation sensing systems for rail tie plates or the like, which could be used in conjunction with a tie plate handling and positioning system.

Tie plates are used to secure rails to railroad ties and comprise a generally flat steel plate with a substantially flat bottom, spike holes and a top having rail securing ribs. The tie plate top is angled to provide a rail seat canted inwardly, with more mass located on the field side of the plate to compensate for the force distribution of trains negotiating curves at high speed.

In the process of reconditioning railroads, the existing rail is removed along with the tie plates, the ties are replaced or resurfaced, and the track bed is refurbished. Before new rails are laid, replacement or recycled tie plates must be accurately positioned upon the ties.

Tie plate replacement is a cumbersome and labor intensive operation, due to the significant weight of the individual plates (18–36 pounds each) and the rapid rate at which they must be positioned to keep up with the other operations of track reconditioning, most of which are largely automated.

Previous attempts at automating the tie plate setting operation have resulted in devices largely concerned with the actual placement of the plates upon the ties. These prior art setters depended upon a supply of plates which had already been manually oriented, either on or off-site. On site, plates may be prepositioned along the shoulder of the track bed, or carried in a gondola to be fed via conveyors to the plate setting device. However, the rapid rate of 30 to 40 plates per minute at which automatic tie plate setters must operate to keep up with the other automated track maintenance equipment requires extensive pre-placement manual handling and sorting of plates. It has been estimated that a member of a plate feeding crew will handle 150,000 pounds per eight hour shift.

Consequently, it is an object of the present invention to provide a plate orientation sensing system to be used in conjunction with an automated plate setter that substantially reduces the amount of manual plate handling required by conventional devices.

It is a further object of the present invention to provide an automatic plate orientation sensing system which has the capability of determining whether plates are right side up or upside down.

It is an additional object of the present invention to provide an automatic plate orientation sensing device which is capable of sensing the orientation of tie plates randomly located across the width of a conveyor surface.

It is a still further object of the present invention to provide an automatic plate orientation sensing system capable of acting in conjunction with an automatic plate reorienting apparatus to properly orient upside down plates.

SUMMARY OF THE INVENTION

The present invention discloses an orientation sensing system for conveyed articles having a mechanically detectable top and bottom, such as railroad tie plates or the like. Such articles need to be placed in proper orientation for optimum utilization.

More specifically, the present orientation sensing system comprises a frame mounted in operational proximity to a conveying surface. The frame is provided with a fixed shaft mounted transversely to the direction of travel of conveyed articles upon the conveyor surface. A plurality of elongate sensor fingers is pivotably attached to the fixed shaft in regularly spaced orientation. Each finger has a length which will intercept conveyed articles traveling upon the conveyor surface. The sensor fingers are designed to swing up in response to a conveyed article, and are biased to return to their original position once the conveyed article passes by. In order to determine the right side up or upside down orientation of the conveyed article, the sensor fingers are set at a height at which they will intercept the discernible features of the conveyed article.

Each sensor finger is equipped with a sensor actuator, such as a beam interrupter disk/opto switch assembly which pivots about the fixed shaft in unison with the sensor finger. Each disk is provided with a notch in its periphery.

A plurality of opto switches are also mounted to the frame, the number of switches corresponding to the number of fingers. Each opto switch is mounted to the frame near the periphery of the beam interruptor disk, so that the disk periphery normally blocks the opto switch light path, keeping the circuit open. The circuit will close when the peripheral notch of the interrupter disk passes the sensor of the opto switch during the pivotal arc of the finger. Each opto switch acts independently of the other opto switches.

The opto switches are connected to a logic circuit which is designed to distinguish the sequencing of signals transmitted by the action of the sensor fingers upon a conveyed article. This sequencing is a means of determining the right side up or upside down orientation of the conveyed article. The logic circuit includes a signal damping or delay feature which prevents false readings due to the random impacting into the sensor fingers by conveyed articles. If the conveyed article is sensed as being upside down, the logic circuit may be connected to an article reorientation means to correct that condition.

BRIEF DESCRIPTION OF THE DRAWINGS

The numerous advantages and attributes of the present invention will become more apparent upon an inspection of the drawings in which.

DESCRIPTION OF THE PREFERRED EMBODIMENT

Figure 1:
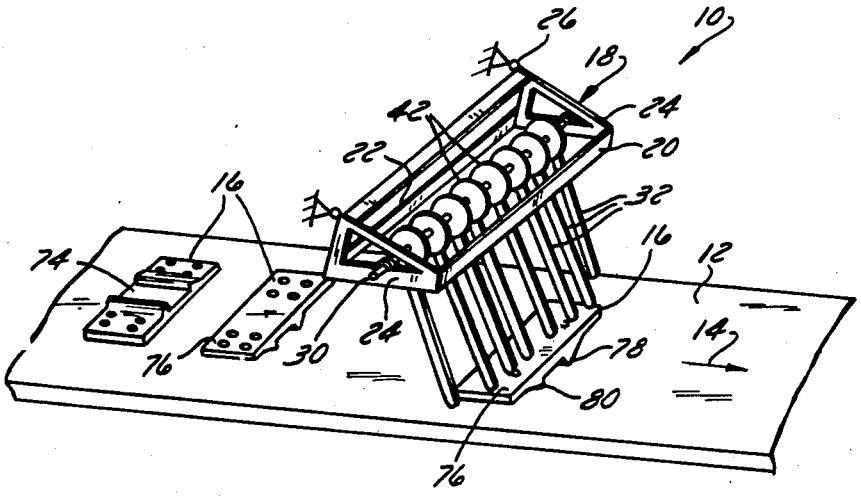
FIG. 1 is a perspective view of the plate orientation sensing sensor of the present invention located above a conveying surface.

Referring now to the drawings, wherein like reference characters designate like features, FIG. 1 depicts the present automatic plate orientation sensor 10 located in close proximity to conveying surface 12. Conveying surface 12 is pictured as a fixed gravity fed conveyor plate, however other forms of fixed or movable conveying surfaces such as moving belts or roller beds are feasible alternatives. In addition, the present conveying surface 12 may be mounted to a mobile framework (not shown) as is conventionally used in automatic rail maintenance devices.

If a conveyor plate is used as the form of conveyor system, its angle of inclination becomes critical as the determining factor for the velocity of conveyed articles. If the angle is not steep enough, articles will not move fast enough. In the alternative, if the angle is too steep, the conveyed articles will move too fast, disrupting the conveyor logic. In the present case, where the conveyed articles are railway tie plates, the preferred angle of conveyor surface inclination is on the order of 23°.

Plates 16 are placed upon conveying surface 12 in proper length-to-width orientation, with the length facing the direction of travel. This placement and preliminary orientation may be performed manually or by a suitable sorting apparatus.

Figure 4:
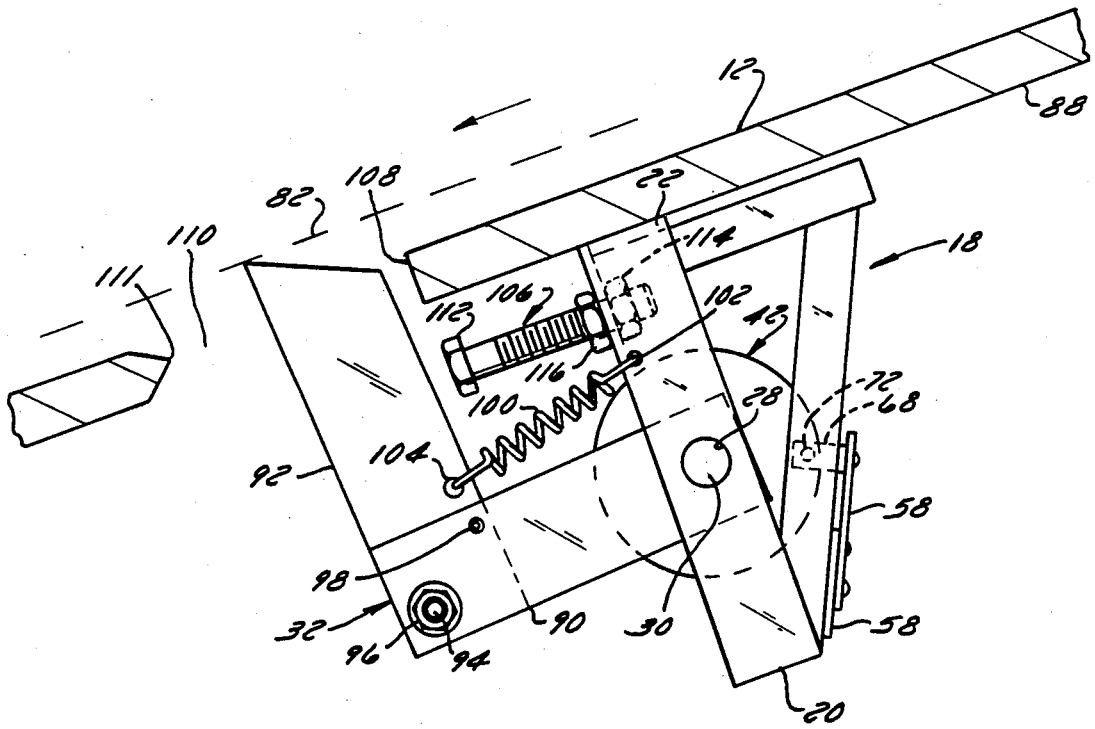
FIG. 4 is a side elevation in partial section of the plate orientation sensing system of the present invention located below the conveying surface.

The present orientation sensor 10 may be located above the conveyor surface, as shown in FIG. 1, or below the conveyor surface as shown in FIG. 4. However, the embodiment depicted in FIG. 1 will be described first. Orientation sensor 10 comprises a rigid sensor frame 18 oriented transversely to the direction of travel 14. Sensor frame 18 is fabricated of lengths of steel angle iron, or suitable conventionally available material, to have parallel front and rear members 20, 22, joined at each side by side supports 24. In the present invention, side supports 24 are triangular in shape for structural support reasons. An additional support member 26 provides a means to mount frame 18 to a conveyor frame (not shown).

Figure 2:
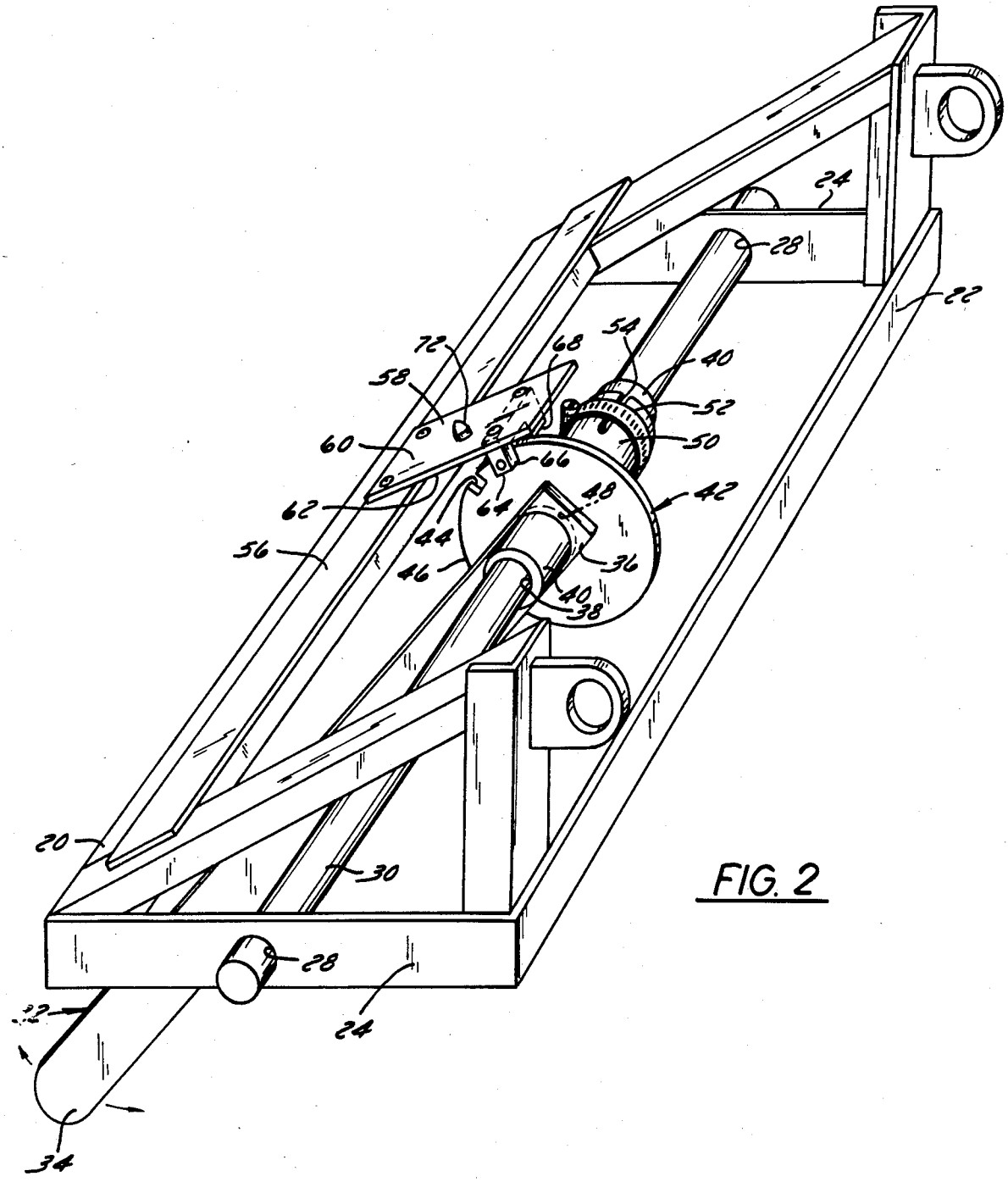
FIG. 2 is an enlarged perspective of the plate orientation sensing system of the present invention showing a single sensor finger in greater detail.

Referring now to FIGS. 1 and 2, side supports 24 are each provided with a shaft engaging aperture 28 approximately midway between front and rear members 20, 22. Shaft engaging apertures 28 are designed to matingly accept rigid shaft 30 in fixed position. Shaft 30 is preferably cylindrical, and serves as a pivot axis for sensor fingers 32, approximately eight of which are located in spaced relationship along shaft 30 to span the width of conveying surface 12.

In the preferred embodiment, sensor fingers 32 are elongate, laterally flattened, rigid members fabricated of light weight steel, aluminum or the like, in a length sufficient to engage conveyor surface 12 from the location of the sensor frame 18. Lighter weight fingers are desirable for their more rapid rate of response. Each finger 32 is provided with a sensing end 34 and a pivot end 36. Sensing end 34 may be rounded or provided with a wear-resistant covering to prevent abrasive wear from repeated contact with plates 16.

Pivot end 36 of finger 32 is provided with an aperture 38 dimensioned to accept shaft 30. A shaft collar 40, dimensioned to accept and freely pivot upon shaft 30, is secured near one end to pivot end 36.

The role of the sensor finers 32 is to mechanically sense the orientation of a conveyed article, such as a tie plate. Means are also provided to transform the mechanical pivoting action of the sensor fingers into electronic signals for transmission to the logic circuit means. Thus, some sort of sensor-activated actuator is needed. This actuator may be a conventionally available micro switch, proximity switch, or, in the preferred embodiment, an opto switch 64. The means of transmitting the mechanical motion of fingers 32 into electrical impulses will be described presently.

A plurality of interruptor disks 42 is provided, one disk for each finger 32. The disks are preferably circular, laterally flattened pieces of rigid material, and are each provided with a notch 44 in their periphery 46. The role of notch 44 will be explained below. Each disk 42 is provided with a central aperture 48 dimensioned to accept shaft 30 and a disk collar 50 fastened to one side by welding or similar fixing means. Disk collar 50 is slid over shaft collar 40 and clamped to the shaft collar via band clamp 52. Slits 54 in disk collar 50 allow the collar to easily collapse and lock onto shaft collar 40. Thus, as presently described, sensor finger 32, collar 40, and disk 46 may freely pivot in unison in an arc between sensor frame front member 20 and rear member 22. During calibration, disk collar 50 can be rotated relative to shaft collar 40 to set the actual trip point of opto switches 64.

A support plate 56, having a length which approximates that of sensor frame front 20, is secured between side supports 24. Plate 56 provides an anchoring point for a plurality of opto switch mounting plates 58, one for each interruptor disk 42. Mounting plates 58 are preferably located normal to the longitudinal axis of support plate 56, and are provided with a length which extends over disk 42. In addition, mounting plate 58 has upper and lower surfaces 60, 62.

An opto switch 64, similar to model TI L143, made by Texas Instruments, is mounted to the underside 62 of opto switch mounting plate 58 in a manner so that beam interruptor disk 42 passes between the signal sending and receiving lobes, 66, 68, of opto switch 64. Each opto switch 64 is provided with an L.E.D. 72 to indicate when the switch has been closed.

The opto switch/disk/sensor finger assembly is calibrated so that when finger 32 pivots upward in response to a conveyed article having a certain height, notch 44 on disk 42 will pass between lobes 66, 68 of opto switch 64 to complete the circuit and send a signal to the logic means 70. Consequently, notch 44 must be of satisfactory dimension to permit a signal to travel between lobes 66, 68 of switch 64 in the time it takes sensor finger 32 to pivot in response to a conveyed article and return to its original position. This calibration is accomplished by loosening the disk collar 50 and lifting finger 32 to a desired height, and rotating beam interruptor disk 42 about shaft 30 until the opto switch triggers and turns on L.E.D. 72.

Figure 3A:
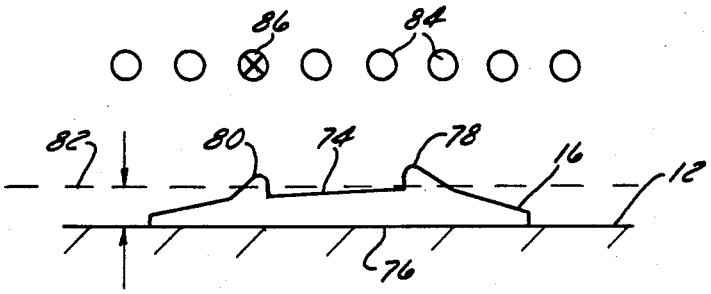
FIG. 3*a* is a sectional view of a tie plate upon a conveyor in proper orientation, and the resulting sensor output.
Figure 3B:
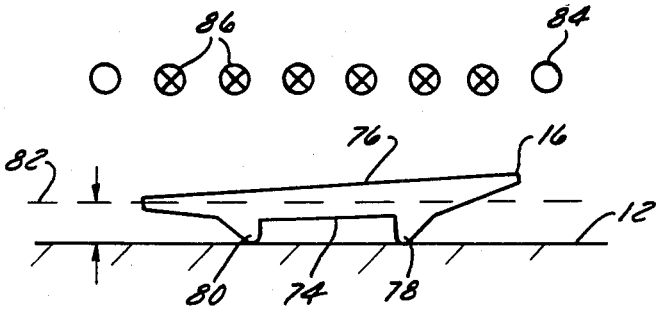
FIG. 3*b* is a sectional view of a tie plate in upside down orientation and the resulting sensor output.

Referring now to FIGS. 3*a* and 3*b*, a tie plate 16 is shown comprised of a top 74, bottom 76, high side rib 78, and low side rib 80. Ideally, sensor fingers 32 will be positioned along a horizontal intercept line 82 which will intersect ribs 78 and 80 when the plate 16 is right-side up. In such a situation, only a maximum of two sensor fingers 32 will be triggered by plate 16. FIG. 3*a* depicts a scenario where plate 16 has shifted transversely on conveyor plate 12 so that only low side rib 80 will intercept a sensor arm 32. In FIGS. 3*a* and 3*b*, an untriggered sensor finger 32 is indicated by empty ball 84, and a triggered sensor finger 32 by filled in ball 86.

In contrast to FIG. 3*a*, FIG. 3*b* depicts a scenario where plate 16 is in an upside down position on conveyor plate 12. Since uniformly flat plate bottom 76 is intercepting line 82, a series of about six consecutive fingers 32 will be triggered. Sensor fingers 32 are set at the height of intercept line 82 by adjusting the height of sensor frame 18 above conveyor plate 12.

As was mentioned previously, sensor frame 18 may be located above conveyor surface 12, or below said surface as shown in FIG. 4. Alternatively, sensor frame 18 may be mounted upon a moving carriage above conveying surface 12.

Referring now to FIG. 4, sensor frame 18 is of the same configuration as in FIGS. 1 and 2, with the only change that frame front member 20 faces vertically downward, and frame rear member 22 abuts against the underside 88 of conveyor surface 12. Sensor frame 18 may be attached to the underside 88 of conveyor surface 12 by conventional means such as welding or mounting bolts. The assembly of shaft 30, collar 40, disks 42 and opto switches 64 will be substantially the same in FIG. 4 as that disclosed in FIG. 1.

Sensor fingers 32 are now fabricated of two pieces, pivot piece 90 and sensor piece 92, the latter oriented at an approximate perpendicular to the former. The position of sensor piece 92 in relation to pivot piece 90 may be established by bolting or welding. In the present embodiment, the position of sensor piece 92 is determined by bolt 94 with lock nut 96, and by spring pin 98.

In addition, an aperture 110 is fashioned in conveying surface 12 to allow access by conveyor fingers 32 to conveyed plates 16. Trailing edge 111 is bevelled to prevent conveyed articles from snagging upon aperture 110.

In FIG. 4, the adjustment of the sensor finger 32 to meet intercept line 82 may be achieved by altering the gap between sensor frame 18 and the underside 88 of conveyor surface 12, as by the insertion of shims (not shown).

The change of orientation in FIG. 4 requires some form of biasing force to return sensor fingers 32 to their original position after a plate 16 passes by. In FIG. 1, this biasing is supplied by gravity; however, in FIG. 4, biasing is provided by coil spring 100, the ends of which are secured in mounting holes, one located in sensor frame 18 at 102 and the other in sensor piece 92 at 104.

A stop means 106 is employed between sensor frame 18 and biased sensor piece 92 of sensor finger 32 to prevent damage to sensor piece 92 through repeated impact upon the edge 108 of conveyor aperture 110. Stop means 106 is comprised of stop bolt 112 which is threaded into rear member 22 of sensor frame 18. A pair of locking jam nuts 114, 116, one threaded to bolt 112 on either side of frame member 22, provide bolt 112 with an adjustably lockable capability, which allows stop means 106 to assist in a positioning of sensor piece 92. The preferred position of the end of sensor piece 92 is to become aligned with intercept line 82.

Figure 5:
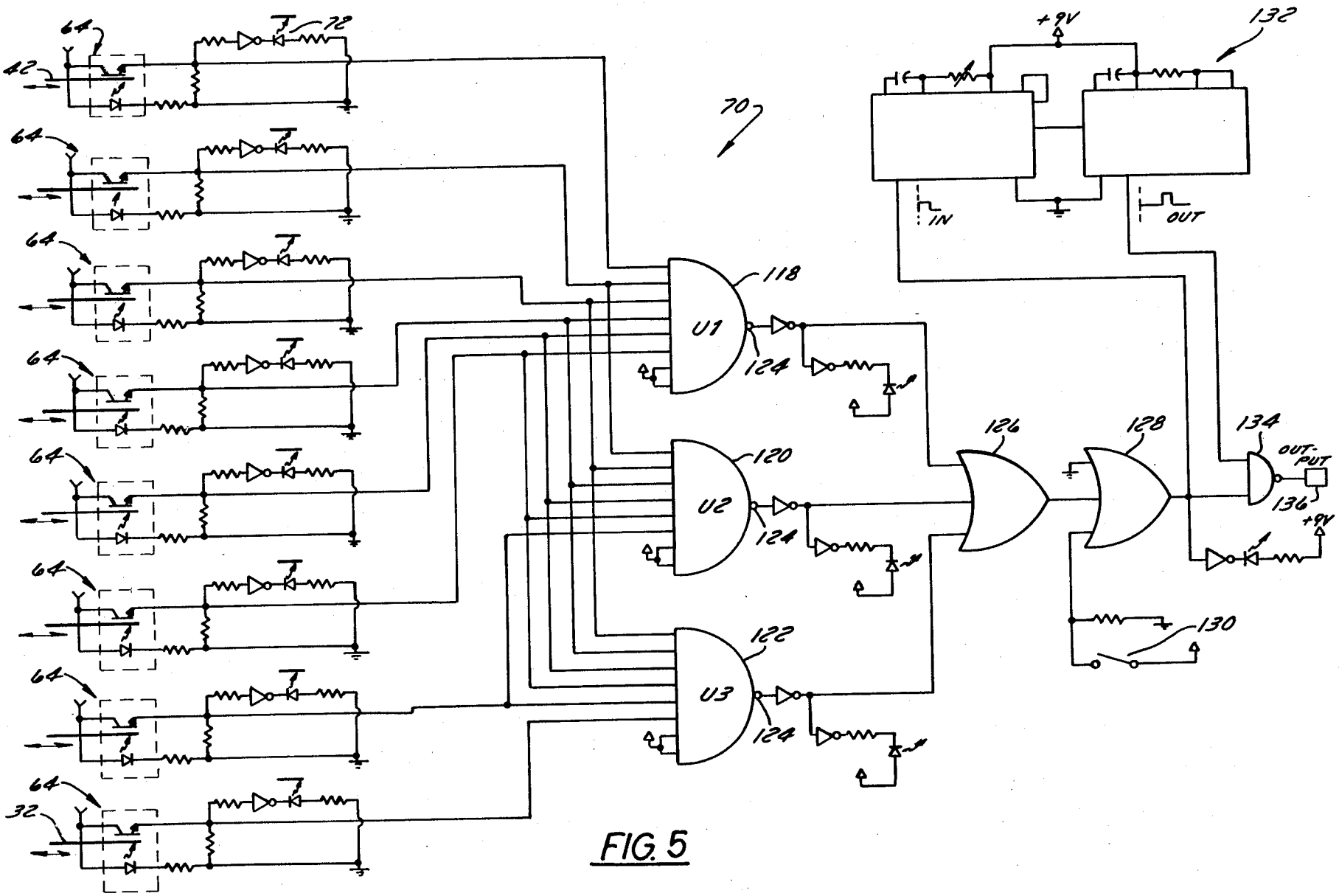
FIG. 5 is a schematic of the circuitry of the present invention.

Referring now to FIG. 5, the circuitry of the present invention is presented in schematic form. A series of eight opto switches 64, each equipped with an L.E.D. output 72 and corresponding to one sensor finger 32 is each connected to each of three "and gates" 118, 120 and 122.

Test results have indicated that a minimum of six consecutive sensor fingers 32 are tripped by an upside down plate 16, or in the embodiment of FIG. 4, by a right side up plate. However, the six consecutive fingers can be in different locations across the conveying surface, since there are eight fingers spanning surface 12. Thus, with eight total fingers, three series of six consecutive sensor fingers are possible. As a result, "and gate" 118 monitors fingers 1–6, gate 120 monitors 2–7, and gate 122 monitors fingers 3–8. Each "and gate" 118, 120 and 122 is wired so that when all six fingers are triggered, a signal is emitted by terminal 124.

Each "and gate" 118, 120 and 122 is connected to "or gate" 126, to determine which signal from 118, 120 or 122 is passed on. Only the signal from one "and gate" 118, 120, 122 will be passed through the "or gate" 126. A second "or gate" 128 is provided to enable the installation of a test switch 130. The test switch 130 is employed to test the reaction of a plate orientation device (not disclosed herein) to a signal from "or gate" 126.

The test results also revealed that since the heavy plates 16 travel across conveyor surface 12 at approximately 300 feet per minute, a significant impact is felt by plates colliding with fingers 32. This impact is felt regardless of whether the plate is right side up or upside down. Upon impact, the sensor fingers would oversw-ing and generate a false signal if not corrected for. Correction of this problem is accomplished by logic "anding" of the original impact signal, which occurs in delay circuit 132. The original signal is time delayed by 30 milliseconds by means of the 'resistance-capacitance' loop of circuit 132. Thus, an original signal, if valid, is followed by a backup signal as a result of the time delay of circuit 132. If both signals are positive, an upside-down plate is assumed to be detected. The signal is then released via "and gate" 134 to output 136. Output 136 may be connected to a plate reorientation device (not shown).

In operation, plates 16 travel along conveyor surface 12 at a speed of 300 feet per minute. As they pass over-/or under sensor frame 18, certain fingers 32 are impacted, depending upon the orientation of the plate 16. If the plate is upside-down, a sequence of six consecutive fingers will be triggered. If the proper sequence of fingers is triggered, the sensor actuator and logic circuits send a signal to the output 136. If the plate is oriented properly, no output signal will be generated.

Thus, the plate orientation sensing system of the present invention provides an automatic sorting device which will enable the plate setting operation to become less labor intensive, and more consistent.

While particular embodiments of this apparatus have been described, it will be obvious to persons skilled in the art that changes and modifications might be made without departing from the invention in its broader aspects.

What is claimed is:

1. An apparatus for sensing the orientation of a conveyed article having a detectable top and bottom comprising:

a conveyor surface;

a sensor means comprising:

a sensor frame mounted in operational proximity to said conveyor surface;

a transverse pivot axis mounted to said sensor frame;

a plurality of sensor fingers, each pivotably mounted to said transverse pivot axis and positioned to intercept said conveyed articles on said conveyor surface and to freely pivot upon said axis in response to said interception;

biasing means to return said fingers to an operating position close to said conveying surface;

a plurality of sensor actuator means, each of said actuator means constructed and arranged to be electronically activated by the pivoting action of said sensor fingers; and logic circuit means connected to said actuator means;

wherein the top-to-bottom orientation of said conveyed article is sensed by the pattern of said fingers intercepting said conveyed articles, said fingers transmitting said pattern to said actuators, and said logic means receiving said patterns from said actuators and sending a signal indicating the top side up or bottom side up orientation of said conveyed article.

2. The apparatus defined in claim 1 wherein said logic means is connected to conveyed article reorientation means.

3. The apparatus defined in claim 1 wherein said fingers are placed in spaced orientation upon said pivot axis to span the width of said conveyor surface.

4. The apparatus defined in claim 1 wherein said sensor frame is located beneath said conveyor surface.

5. The apparatus defined in claim 4 wherein said conveyor surface has a plurality of spaced apertures through which said fingers project to intercept said conveyed article.

6. The apparatus defined in claim 1 wherein said frame is located above said conveyor surface.

7. The apparatus defined in claim 1 wherein said conveyed articles have a desired orientation, with said top side facing up, and an undesired orientation with said top side facing down.

8. The apparatus defined in claim 7 wherein said article top side has vertically projecting portions which would intercept a select few of said fingers, and said bottom side is of a uniform configuration which intercepts a consecutive series of said fingers.

9. The apparatus defined in claim 1 wherein said actuator means comprise the plurality of beam interruptor means, each of said means having a peripheral notch and constructed and arranged to pivot with a corresponding finger about said axis, and a plurality of opto switches, each of said switches corresponding to and straddling one of said beam interruptor means.

10. An apparatus for sensing the orientation of conveyed articles such as rail tie plates or like articles having distinct top and bottom sides upon a conveyor surface having a width comprising:

a support frame secured in operating relationship to said conveyor surface;

a shaft mounted in said frame transverse to said conveyor surface;

a plurality of elongate sensor fingers, each having a first end and a second end, said first end designed to intercept conveyed articles, and said second end designed to pivot about said shaft, said fingers having a first position adjacent to said conveyor surface, and a second lifted position occurring when said first end of said finger engages one of said articles;

biasing means designed to return each of said fingers to said first position;

a plurality of beam interruptor disks, each disk having a periphery, a peripheral notch and an axial bore designed to rotatably engage said shaft, each of said disks being constructed and arranged to rotate about said shaft in unison with one of said fingers;

a plurality of opto switches, each switch comprising means to direct an interruptable beam transversely through said periphery of one of said disks; and logic circuit means, comprising means to receive input from each of said opto switches, wherein said interruptor disks are positioned upon said shaft in relation to said finger so that when said finger pivots from said first position to said second position in response to a conveyed article, said notch is situated to allow said opto switch beam to complete and close said circuit, thus sending a signal to said logic means regarding the orientation of said conveyed article.

11. The apparatus defined in claim 10 wherein said fingers are placed in spaced orientation upon said transverse support shaft to span said conveyor surface.

12. The apparatus defined in claim 11 wherein said frame is located beneath said conveyor surface.

13. The apparatus defined in claim 12 wherein said conveyor surface has an aperture through which said fingers project to intercept said conveyed article.

14. The apparatus defined in claim 10 wherein said frame is located above said conveyor surface.

15. The apparatus defined in claim 10 further comprising means for correcting the orientation of said articles.

16. The apparatus defined in claim 15 wherein said rail tie plates have a desired orientation, with said top side facing up and an undesired orientation with said top side facing down.

17. The apparatus defined in claim 16 wherein said plate top side has vertically projecting portions which would intercept a select few of said fingers, and said bottom side is of a uniform configuration which intercepts a consecutive series of said fingers.

18. The apparatus defined in claim 17 wherein said logic means is designed to signal said plate orientation correcting means when said plate top side faces downward.

19. The apparatus defined in claim 10 wherein said logic means further comprises a signal delay means.

20. The apparatus defined in claim 19 wherein said logic signal delay means comprises a resistance-capacitance "anding" circuit.

* * * * *